US010151553B2

(12) United States Patent
Yu

(10) Patent No.: US 10,151,553 B2
(45) Date of Patent: Dec. 11, 2018

(54) PIERCING DEVICE FOR GAS BOTTLE, MAGAZINE AND PISTOL COMPRISING THE SAME

(71) Applicant: Fung Wan Connie Yu, Hong Kong (HK)

(72) Inventor: Fung Wan Connie Yu, Hong Kong (HK)

( * ) Notice: Subject to any disclaimer, the term of this patent is extended or adjusted under 35 U.S.C. 154(b) by 0 days.

(21) Appl. No.: 15/644,816

(22) Filed: Jul. 9, 2017

(65) Prior Publication Data

US 2018/0188000 A1 Jul. 5, 2018

(30) Foreign Application Priority Data

Jan. 4, 2017 (HK) ..... 17100089.3

(51) Int. Cl.
*F41B 11/56* (2013.01)
*F41B 11/62* (2013.01)

(52) U.S. Cl.
CPC ..... *F41B 11/62* (2013.01); *F41B 11/56* (2013.01)

(58) Field of Classification Search
CPC ..... F41B 11/62; F41B 11/56; F41B 11/723
See application file for complete search history.

(56) References Cited

U.S. PATENT DOCUMENTS 3,207,143 A * 9/1965 Kline ..... F41B 11/62 124/40
3,527,194 A * 9/1970 Desrochers ..... F41B 11/62 124/37
4,150,656 A * 4/1979 Curran ..... F41B 11/62 124/74
7,398,776 B2 * 7/2008 Casas Salva ..... F41B 11/56 124/74
8,079,355 B1 * 12/2011 Chung ..... F41B 11/55 124/71
8,602,784 B2 * 12/2013 Dvorak ..... F41A 33/02 434/11
9,157,694 B1 * 10/2015 Tseng ..... F41B 11/62
9,593,905 B2 * 3/2017 Tseng ..... F41B 11/62
9,719,747 B2 * 8/2017 Tiberius ..... F41A 33/02

FOREIGN PATENT DOCUMENTS

DE 1094631 B * 12/1960 ..... F41B 11/62
DE 2730125 A1 * 1/1979 ..... F41B 11/62

* cited by examiner

*Primary Examiner* — Stephen Johnson
*Assistant Examiner* — Joshua T Semick
(74) *Attorney, Agent, or Firm* — Wayne & King LLC

(57) ABSTRACT

A piercing device is provided, which comprises a housing movable with respect to a gas bottle holder having a gas bottle held therein; a piercing element received in the housing and configured for piercing into a sealing membrane of the gas bottle; and a stressing element, received in the housing; the piercing element being fixed on one end of the stressing element that is close to the gas bottle; the stressing element being capable of synchronously rotating along with the housing for being inserted into the gas bottle, or individually rotating and moving with respect to the housing for pushing the piercing element to pierce into the sealing membrane or releasing gas inside the gas bottle.

8 Claims, 7 Drawing Sheets

PIERCING DEVICE FOR GAS BOTTLE, MAGAZINE AND PISTOL COMPRISING THE SAME

CROSS-REFERENCE TO RELATED APPLICATIONS

This application claims priority to Hong Kong Patent Application No. 17100089.3 with a filing date of Jan. 4, 2017. The content of the aforementioned applications, including any intervening amendments thereto, are incorporated herein by reference.

TECHNICAL FIELD

The present application relates to the technical field of gas conveying system, and more particularly, relates to a piercing device for a gas bottle, a magazine and a pistol comprising the piercing device.

BACKGROUND OF THE PRESENT INVENTION

In a pistol of the prior art, a single-used gas bottle is generally used to be vertically mounted in a magazine which is fixedly mounted in the pistol, and thus the gas inside the gas bottle is directly supplied to the pistol. However, when using the pistol of this type, the pressure of the gas is instable, which results in a discontinuous gas supply. Besides, the gas can not be used up, a part of the gas is wasted, and thus the gas has a low utilization. Furthermore, the magazine can not be portable and can not be further removed after it is mounted in the pistol. When the gas is substantially used up, the magazine needs to be opened to take out the old gas bottle, and further insert a new one. Therefore, the replacement of the gas bottle is complicated and inconvenient.

SUMMARY OF PRESENT INVENTION

The objective of the present application is to provide a piercing device for a gas bottle, a magazine, and a pistol comprising the piercing device.

In accordance with an aspect of the present application, a piercing device is provided, which comprises: a housing movable with respect to a gas bottle holder having a gas bottle held therein; a piercing element received in the housing and configured for piercing into a sealing membrane of the gas bottle; and a stressing element, received in the housing; the piercing element being fixed on one end of the stressing element that is close to the gas bottle; the stressing element being capable of synchronously rotating along with the housing for being inserted into the gas bottle holder, or individually rotating and moving with respect to the housing for pushing the piercing element to pierce into the sealing membrane or releasing gas inside the gas bottle.

In a preferred embodiment, a first recess is defined at one end of the housing that is away from the gas bottle, and a second recess is defined at the other end of the stressing element that is away from the gas bottle; the second recess is capable of aligning with or misaligning with the first recess.

In a preferred embodiment, a width of the first recess is larger than or equivalent to a width of the second recess.

In a preferred embodiment, an external thread is formed on an outer wall of the stressing element, and an internal thread adapted to the external thread on the stressing element is formed on an inner wall of the housing.

In a preferred embodiment, an external thread is formed on an outer wall of the housing, while an internal thread adapted to the external thread on the outer wall the housing is formed on an inner wall of the gas bottle holder.

In a preferred embodiment, a sealing ring used as an indicator for indicating a position of the housing and configured for firmly sealing the piercing device in the gas bottle holder is provided on the outer wall of the housing.

In accordance with a further aspect of the present application, a piercing device is further provided, which comprises a housing movable with respect to a gas bottle holder having a gas bottle held therein; the housing having a first recess defined at one end thereof that is away from the gas bottle; a piercing element received in the housing and configured for piercing into a sealing membrane of the gas bottle; and a stressing element, received in the housing; the piercing element being fixed on one end of the stressing element that is close to the gas bottle; the stressing element being capable of synchronously rotating along with the housing for being inserted into the gas bottle holder, or individually rotating and moving with respect to the housing for pushing the piercing element to pierce into the sealing membrane or releasing gas inside the gas bottle; the stressing element having a second recess defined at one other end thereof that is away from the gas bottle; the second recess being capable of aligning with or misaligning with the first recess; wherein an external thread is formed on an outer wall of the stressing element, and an internal thread adapted to the external thread on the stressing element is formed on an inner wall of the housing; a sealing ring used as an indicator for indicating a position of the housing and configured for firmly sealing the piercing device in the gas bottle holder is provided on the outer wall of the housing.

In accordance with a further aspect of the present application, a magazine is further provided, which comprises: a gas bottle, having a sealing membrane sealed at a mouth thereof; a gas bottle holder, configured for holding the gas bottle; and a piercing device, including: a housing movable with respect to a gas bottle holder having a gas bottle held therein; a piercing element received in the housing and configured for piercing into a sealing membrane of the gas bottle; and a stressing element, received in the housing; the piercing element being fixed on one end of the stressing element that is close to the gas bottle; the stressing element being capable of synchronously rotating along with the housing for being inserted into the gas bottle holder, or individually rotating and moving with respect to the housing for pushing the piercing element to pierce into the sealing membrane or releasing gas inside the gas bottle.

In a preferred embodiment, a first recess is defined at one end of the housing that is away from the gas bottle, and a second recess is defined at the other end of the stressing element that is away from the gas bottle; the second recess is capable of aligning with or misaligning with the first recess; a width of the first recess is larger than or equivalent to the a width of the second recess.

In a preferred embodiment, an external thread is formed on an outer wall of the stressing element, and an internal thread adapted to the external thread on the stressing element is formed on an inner wall of the housing.

In a preferred embodiment, a sealing ring used as an indicator for indicating a position of the housing and configured for firmly sealing the piercing device in the gas bottle holder is provided on the outer wall of the housing.

In a preferred embodiment, a first stopping portion is formed on the inner wall of the holding casing, and a second stopping portion adapted to the first stopping portion is provided at one end of the housing that is close to the gas bottle.

In accordance with a further aspect of the present application, a pistol is further provided, comprising the magazine described above.

The piercing device for gas bottle, the magazine and pistol comprising the piercing device of the present application introduce a piercing device 300 for sealing the gas bottle holder and previously piercing the gas bottle. Therefore, there is sufficient time and space for the gas to gasify and the pressure of the gas is stable. In this way, when using the magazine of this type into the pistol, the gas can be evenly supplied to the pistol, the gas can be even used up, and an improved shooting effect can be achieved. Beside, the magazine can be portable without worrying about a leakage of the gas inside the magazine, and when the gas inside the magazine is substantially used up, the whole magazine can be removed expediently.

DESCRIPTION OF THE DRAWINGS

The present application will be further described with reference to the accompanying drawings and embodiments in the following, in the accompanying drawings.

DETAILED DESCRIPTION OF PREFERRED EMBODIMENTS

Figure 1:
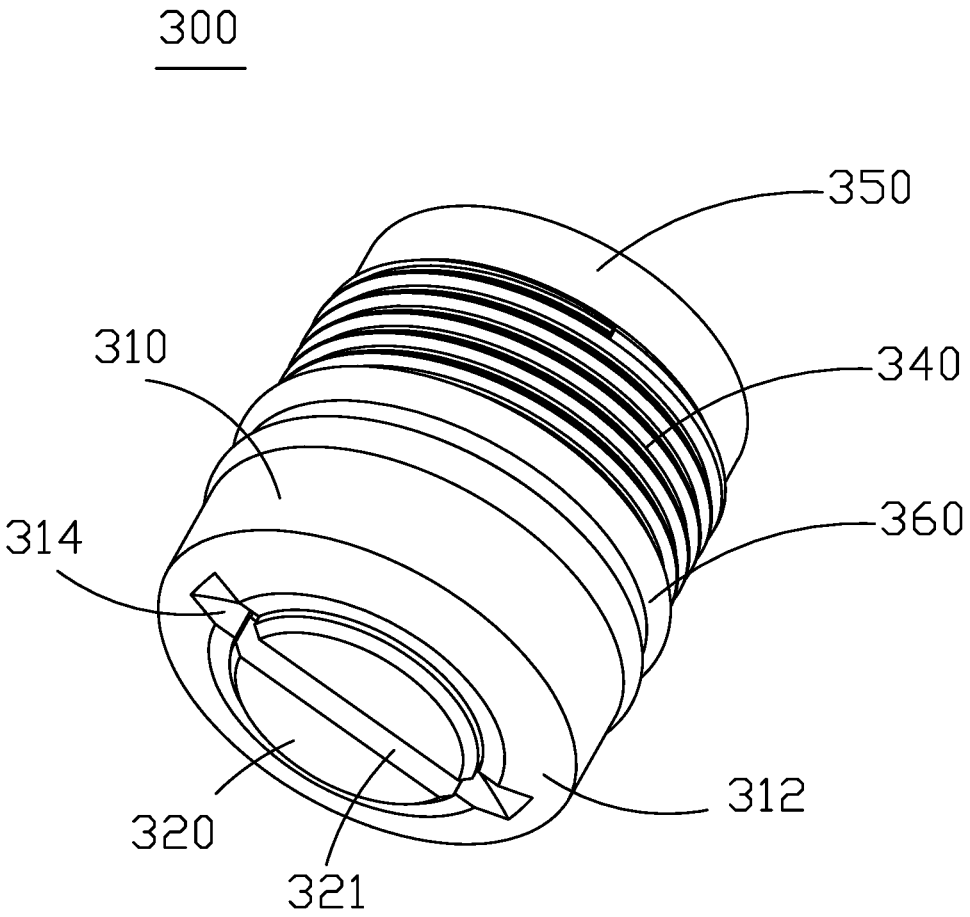
FIG. 1 is a schematic view of a piercing device viewed from a first direction according to a preferred embodiment of the present application.

In order to make the technical features, the propose and the technical effect of the present application more clearly, the specific implemental means of the present application will now be described in detail with reference to the accompanying drawings.

FIGS. 3-7 schematically show a magazine according to a preferred embodiment of the present application. In this case, the magazine is used in a pistol. However, it is also possible to use this magazine into any apparatus which needs gas supply.

As is shown in FIGS. 3-7, the magazine of the present application substantially includes a gas bottle 100, a gas bottle holder 200 for holding the gas bottle 100, and a piercing device 300. In this case, the gas bottle 100 is held or received in the gas bottle holder 200 and has high-pressure gas, such as compressed air, stored therein. The gas bottle 100 is generally made from steel, and has a sealing membrane 110 sealed at a mouth (not labeled) of thereof. The sealing member 110 is configured for sealing the gas bottle 100 and retaining the high-pressure gas in the gas bottle 100. The sealing membrane 110 is preferably made from metal.

As is specifically shown in FIGS. 3-7, the gas bottle holder 200 includes a holding casing 210 having a holding cavity 220 defined therein. The gas bottle 100 is held in the holding cavity 220. In this case, it is preferably that the gas bottle 100 is abutted against an inner wall of the holding casing 210.

Furthermore, an opening 230 is formed at one end of the holding casing 210. The piercing device 300 is provided at the opening 230 of the gas bottle holder 200 for sealing the gas bottle holder 200. In addition, the piercing device 300 is movable along a longitudinal axis L1 of the gas bottle holder 200 in such a way that the sealing membrane 110 of the gas bottle 100 can be pierced by the piercing device 300, and thus the gas can escape from the gas bottle 100 and further enters the holding cavity 220 of the gas bottle holder 200 before the magazine is applied into a pistol.

Figure 2:
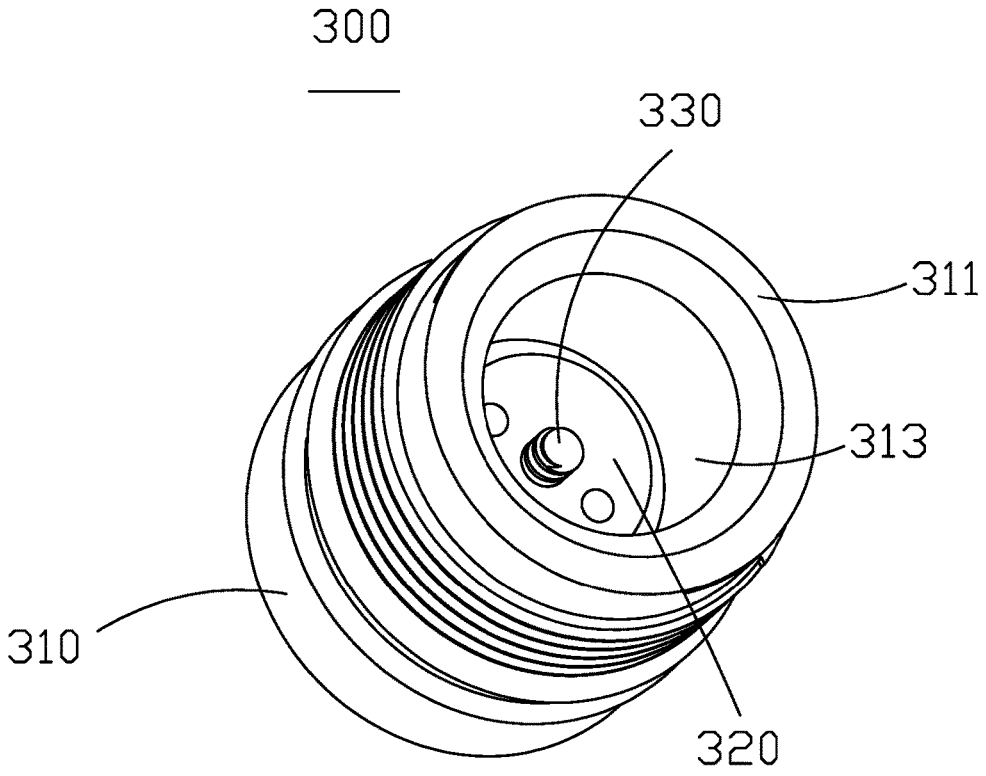
FIG. 2 is a schematic view of the piercing device viewed from a second direction according to the preferred embodiment of the present application.

FIGS. 1-2 specifically show the structure of the piercing device 300. As is further shown in FIGS. 1-2, the piecing device 300 includes a housing 310 which is movable along the longitudinal axis L1 of the gas bottle holder 200, a stressing element 320 which is synchronously rotatable along with the housing or individually rotatable and movable with respect to the housing 310, and a piercing element 330 received in the housing 310 and fixed on the stressing element 320.

Here, "synchronously rotatable" means that the stressing element 320 seems to be integrated with the housing 310 at this time, and thus the position of the stressing element 320 and that of the housing 310 are changed synchronously. However, "individually rotatable and movable" means that, the stressing element 320 is separated from the housing 310, and is rotated and moved such that the position of the stressing element 320 is changed while the housing 310 is fixed.

Figure 3:
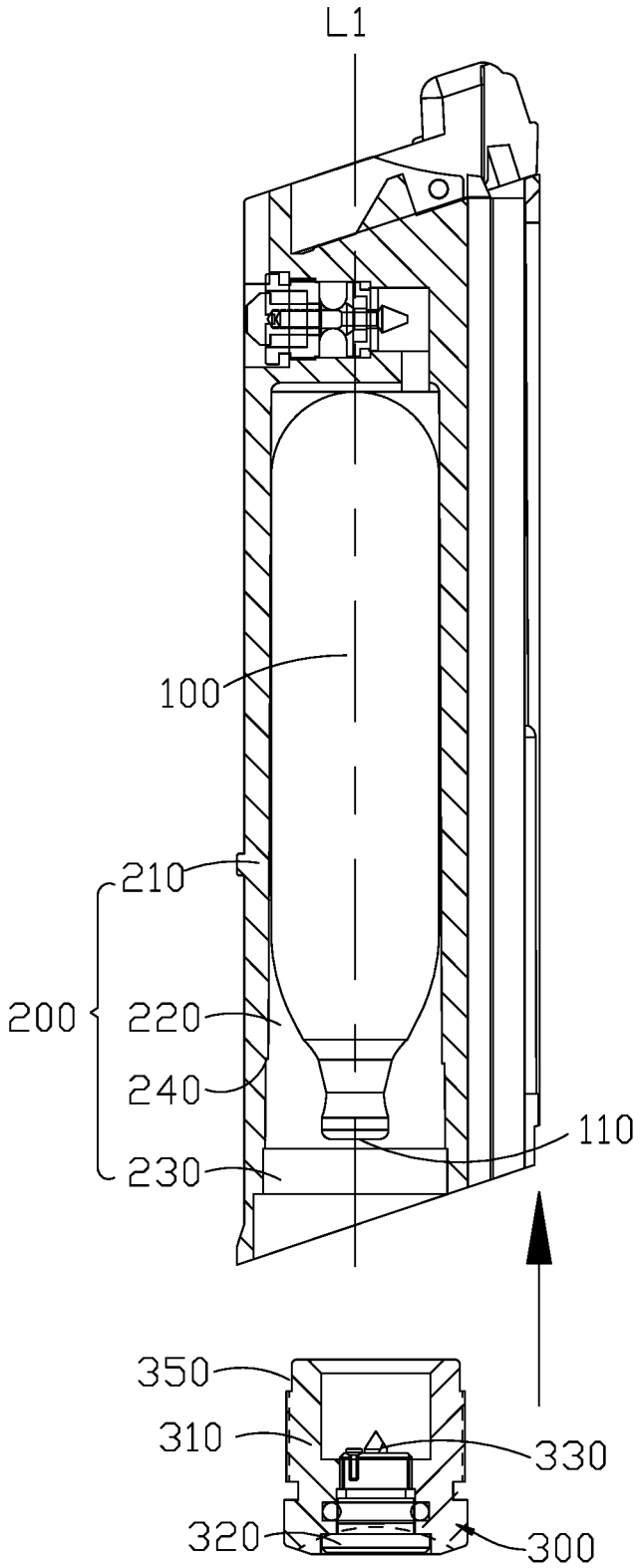
FIG. 3 is a schematic view of a magazine comprising a piercing device according to a preferred embodiment of the present application, wherein the piercing device is separated from the gas bottle holder.

The housing 310 in this case is substantially in shape of a hollow cylinder, and includes a first end 311 and a second end 312 opposite to the first end 311. As is shown in FIGS. 1-3, the first end 311 is the end of the housing 310 that is close to the gas bottle 100 when the piercing device 300 is sealed at the opening 230 of the gas bottle holder 200. That is, the first end 311 is received in the holding cavity 220, while the second end 312 stays outside the gas bottle holder 200 in such a way that a user may operate the piercing device 300 via the second end 312. A through-hole 313 is further defined substantially in the middle of the housing 310, and thus the stressing element 320 may be received in the through-hole 313 of the housing 310.

Furthermore, a first recess 314 is further defined at the second end 312 of the housing 310 that is away from the gas bottle. A driving element (not shown) is capable of being inserted into the first recess 314, in order to drive the housing 310 to move with respect to the gas bottle holder 200.

In this case, as is shown in FIGS. 1-2, an external thread 340 is further formed on an outer wall of the housing 310. Correspondingly, an internal thread (not shown) adapted to the external thread 340 on the outer wall the housing 310 is further formed on the inner wall of the holding casing 210. In this way, the piercing device 300 may be screwed onto the gas bottle holder 200, and the opening 230 of the holding casing 210 is sealed by the piercing device 300 as a result.

In this case, as is shown in FIGS. 1-2 and combing with FIG. 3, a first stopping portion 240 is formed on the inner wall of the holding casing 210; the first stopping portion 240 is configured for limiting a position of the piercing device 300. In this case, the first stopping portion 240 is a stopping step.

Correspondingly, a second stopping portion 350 is provided at the first end 311 of the housing 310 that is close to the gas bottle 100. The second stopping portion 350 is adapted to the first stopping portion 240; in this way, when the piercing device 300 is screwed in the holding casing 210, the position of the piercing device 300 is limited.

Preferably, in this case, a sealing ring 360 is further provided on the outer wall of the housing 310 for firmly sealing the piercing device 300 into the gas bottle holder 200 and enhancing the sealing effect between the gas bottle holder 200 and the piercing device 300. The sealing ring 360 can be used as an indicator for indicating the position of the housing 310 and helping with the operation of the user. For example, if the housing 310 is screwed into the holding casing 210 with the sealing ring 360 is completely received in the holing cavity 220, the user may stop screwing the housing 310; otherwise, the user should further screw the housing 310 into the holing cavity 220. Preferably, the sealing ring is in shape of an "○".

Referring to FIGS. 1-2 again, the stressing element 320 is received in the through-hole 313 of the housing 310, and is rotatable and movable with respect to the housing 310 further. The stressing element 320 is capable of synchronously rotating along with the housing 310 for being inserted into the gas bottle holder 200, or individually rotating and moving with respect to the housing 310 for pushing the piercing element 330 to pierce into the sealing membrane 110 or releasing gas inside the gas bottle 100.

Figure 4:
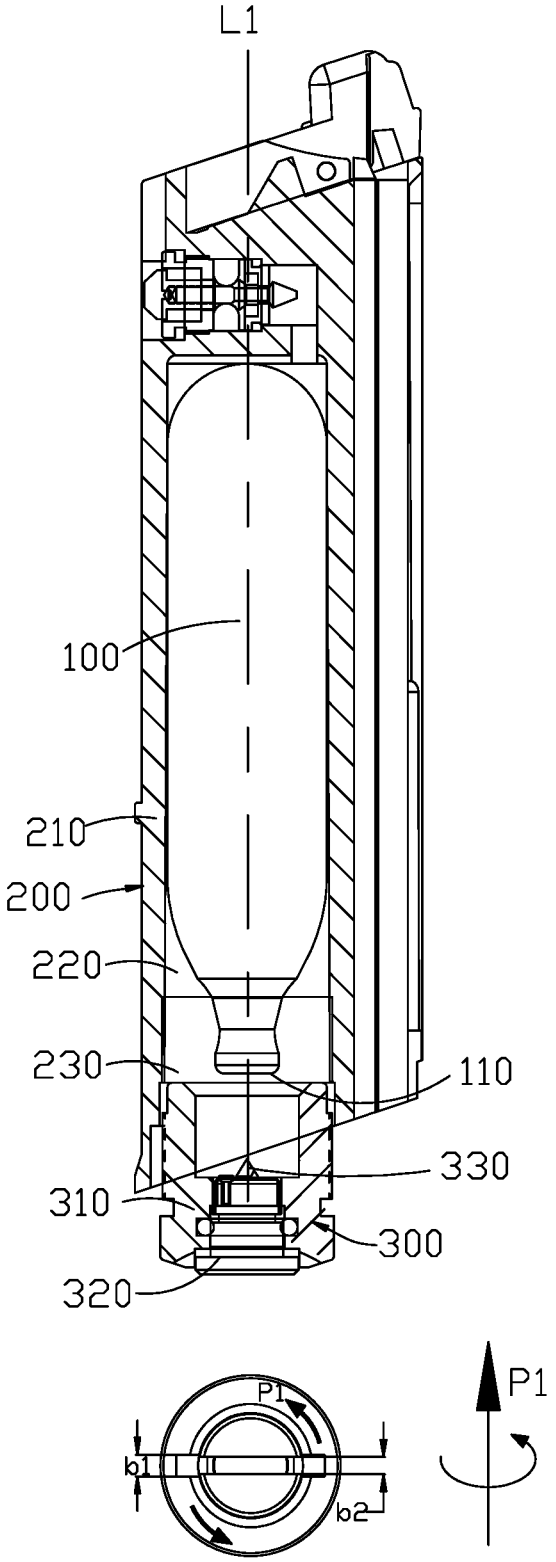
FIG. 4 is a schematic view of the magazine comprising the piercing device according to the preferred embodiment of the present application, wherein the piercing device is partially inserted into the gas bottle holder with the stressing element being in a releasing state.
Figure 6:
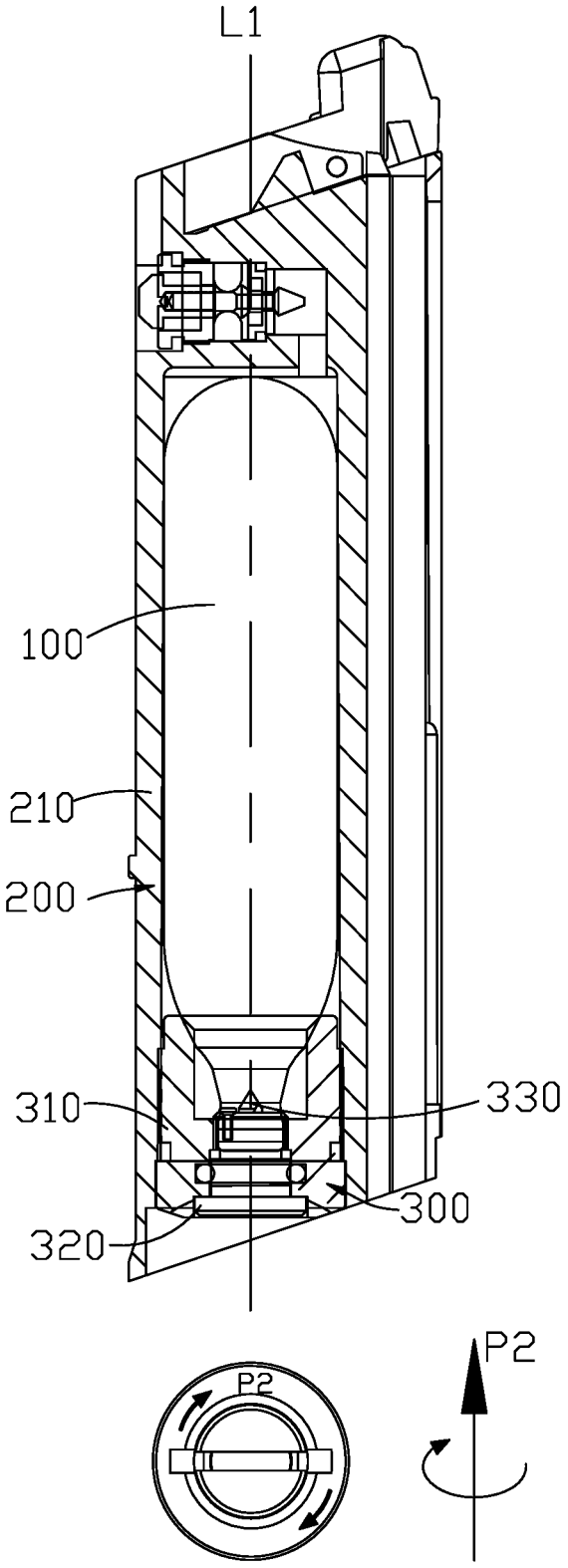
FIG. 6 is a schematic view of the magazine comprising the piercing device according to the preferred embodiment of the present application, wherein the piercing device is completely and tightly inserted into the gas bottle holder with the stressing element being in a stressing state.

Specifically, when the stressing element 320 rotates in a first direction P1 as is shown in FIG. 4, the stressing element 320 is retracted in a direction away from the gas bottle 100. However, when the stressing element 320 rotates in a second direction P2 as is shown in FIG. 6, the stressing element 320 is extended in a direction close to the gas bottle 100, and pushes the piercing element 330 to further pierce into the gas bottle 100.

In this case, the stressing element 320 is substantially in shape of a cylinder. An external thread (not shown) may be formed on an outer wall of the stressing element 320, while a corresponding internal thread (not shown) adapted to the external thread on the stressing element 320 may be formed on an inner wall of the housing 310. In this way, the stressing element 320 is rotatable with respected to the housing 310 and is further movable with respect to the housing 310 during the rotation thereof.

As is further shown in FIGS. 1-2, a second recess 321 is further defined at one end of the stressing element 320 that is away from the gas bottle 100 when the piercing device 300 is screwed into the gas bottle holder 200. The second recess 321 is capable of aligning with or misaligning with the first recess 314, in such a way that the stressing element 320 is synchronously rotated with the housing 310 or the stressing element 320 is individually rotated with respect to the housing 310. When the second recess is aligned with the first recess 314, the driving element is capable of being inserted into the first recess 314 and the second recess 321 simultaneously, thereby driving the housing 310 and the stressing element 320 to move or rotate synchronously. However, it is also possible to drive the stressing element 320 to rotate individually with respect to the housing 310 and further move in the housing 310 by using another driving element which is only inserted into the second recess 321. Preferably, a width b1 of the first recess 314 is larger than or equivalent to a width b2 of the second recess 321.

The piercing element 330 is fixed on the other end of the stressing element 20 that is close to the gas bottle 100. In this case, the piercing element 330 is in shape of a tip which is capable of being pierced into the sealing membrane 110 of the gas bottle 100, causing the high-pressure gas to escape from the gas bottle 100.

The operation of the magazine of the present application will be further described below accompanying with FIGS. 1-7.

As is shown in FIG. 3, initially, a gas bottle 100 is inserted into the gas bottle holder 200 reversedly (which means a mouth of the gas bottle 100 is located at a lower position than the bottom of the gas bottle 100 in a gravity direction), and the piercing device 300 is separated from the gas bottle cavity 200. When preparing the magazine for a pistol, the user firstly needs to align the piercing device 300 with the opening 230 of the gas bottle holder 200 to ensure a precise positioning of the piercing device 300.

After that, as is shown in FIG. 4, a first driving element (such as a metal plate) is inserted into the first recess 314 and the second recess 321 simultaneously, thereby driving the housing 310 and the stressing element 320 to screw synchronously and partially into the gas bottle holder 200. However, the piercing element 330 has not yet get into contact with the sealing membrane 110 of the gas bottle 100 at this time. And the first driving element is removed after that.

Then a second driving element is inserted into the second recess 321 only, and thus the stressing element 320 is controlled to rotate individually by the driving element (for example, one revolution) in the first direction P1. In this way, the stressing element 320 is moved backwardly for a certain distance in the direction away from the gas bottle 100. In this way, when the piercing element 330 is just pierced into the sealing membrane 110 of the gas bottle 100, the piercing element 330 will not be tightly clamped, thereby it is easily for the piercing element 330 to be screwed further after the sealing membrane 110 is pierced by the piercing element 330.

Figure 5:
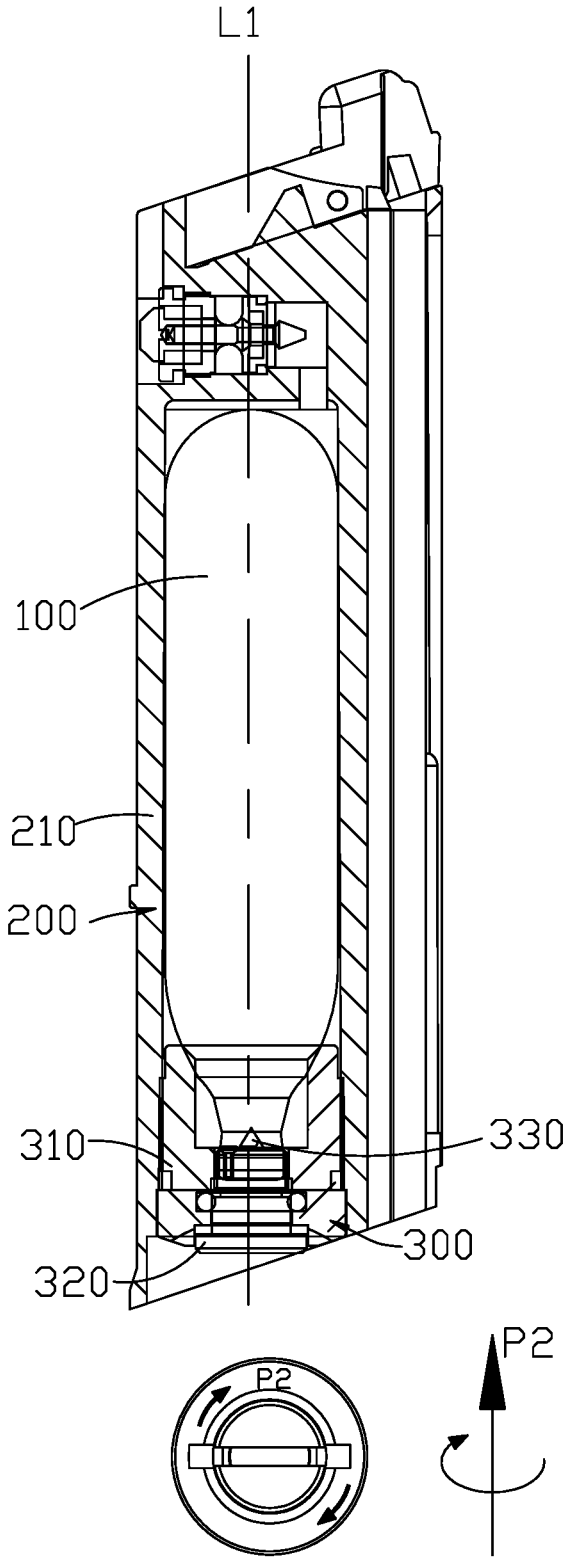
FIG. 5 is a schematic view of the magazine comprising the piercing device according to the preferred embodiment of the present application, wherein the piercing device is completely and tightly inserted into the gas bottle holder with the stressing element being in the releasing state.

As is shown in FIG. 5, after the stressing element 320 is moved backwardly, the housing 310 together with the stressing element 320 are synchronously and completely screwed further in the second direction P2 by using the first driving element until the sealing ring 360 can not be seen from the outside. During this process, the piercing element 330 is pierced into the sealing membrane 110, and a sound indicating that the sealing membrane 110 is pierced may be heard.

After that, as is shown in FIG. 6, the stressing element 320 is controlled to rotate in the second direction P2 individually with respect to the housing 310 by the second driving element in such a way that, the stressing element 320 pushes the piercing element 330 to fully pierce into the gas bottle 100 in order to ensure that the gas exits evenly.

Figure 7:
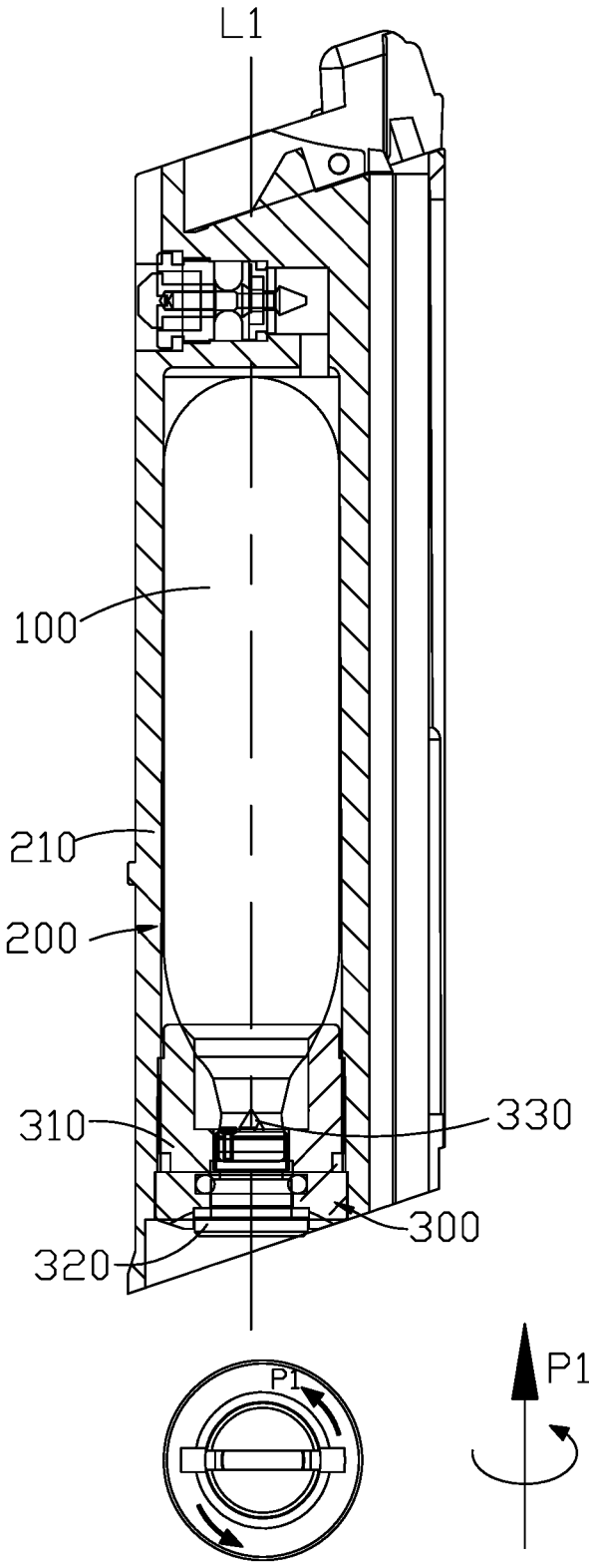
FIG. 7 is a schematic view of the magazine comprising the piercing device according to the preferred embodiment of the present application, wherein the piercing device is completely and tightly inserted into the gas bottle holder with the stressing element being in the opening state again.

Finally, as is shown in FIG. 7, the stressing element 320 is controlled to rotate (for example, 0.5-1 revolution) in the first direction P1 individually with respect to the housing 310 by the second driving element in such a way that, the stressing element 320 is retracted backwardly in the direction away from the gas bottle 100. Preferably, in this case, the stressing element 320 is rotated until the stressing element 320 and the second end 312 of the housing 310 are at the same level.

In this way, the stressing element 320 will not block the gas outlet of the sealing membrane 110 formed by the piercing element 330. Since the piercing device 300 is screwed firmly inside the gas bottle holder 200, the piercing device 300 can be used as a sealing device for the gas bottle holder 200. Therefore, the gas can enter the holding cavity 210 of the gas bottle holder 200 before the whole magazine is applied into the pistol.

After that, the magazine can be portable and can be further inserted into a pistol to supply gas to the pistol.

Therefore, in the magazine and pistol of the present application, a piercing device 300 is provided for sealing the gas bottle holder and previously piercing the gas bottle. Therefore, there is sufficient time and space for the gas to gasify and the pressure of the gas is stable. In this way, when using the magazine of this type into the pistol, the gas can be evenly supplied to the pistol, the gas can be even used up, and an improved shooting effect can be achieved. Beside, the magazine can be portable without worrying about a leakage of the gas inside the magazine, and when the gas inside the magazine is substantially used up, the whole magazine can be removed expediently.

Although the present application is illustrated with the embodiments accompanying the drawings, however, it should be understood that, those skilled in the art may make many alternatives or equivalents, without going beyond the scope the claims intend to protect of the present application. Besides, many modifications may be made aiming at specific situation or materials, without going beyond the scope the claims intend to protect of the present application. Therefore, the present application is not limited to the specific embodiments disclosed herein, and the present application should include all the implementations fallen in the protection scope of the claims of the present application.

I claim:

1. A piercing device for a gas bottle, comprising:

a housing movable with respect to a gas bottle holder having the gas bottle held therein;

a piercing element received in the housing and configured for piercing into a sealing membrane of the gas bottle; and a stressing element received in the housing; the piercing element being fixed on one end of the stressing element that is close to the gas bottle; the stressing element being synchronously rotatable along with the housing, and individually rotatable and movable with respect to the housing;

wherein a first recess is lied across one end of the housing that is away from the gas bottle, and a second recess is lied across one end of the stressing element that is away from the gas bottle; the second recess is capable of aligning with or misaligning with the first recess; when the stressing element is rotated to make the second recess align with the first recess, a semi-open channel with an open mouth facing away from the gas bottle is formed;

an external thread is formed on an outer wall of the stressing element, and an internal thread adapted to the external thread on the stressing element is formed on an inner wall of the housing.

2. The piercing device according to claim 1, wherein a width of the first recess is larger than or equivalent to a width of the second recess.

3. The piercing device according to claim 1, wherein an external thread is formed on an outer wall of the housing, while an internal thread adapted to the external thread on the outer wall the housing is formed on an inner wall of the gas bottle holder.

4. The piercing device according to claim 1, wherein a sealing ring is provided on an outer wall of the housing and configured for indicating a position of the housing; the piercing device is firmly secured to the gas bottle holder.

5. A magazine, comprising:

a gas bottle, having a sealing membrane sealed at a mouth thereof;

a gas bottle holder, configured for holding the gas bottle; and a piercing device, including:

a housing movable with respect to a gas bottle holder having a gas bottle held therein;

a piercing element received in the housing and configured for piercing into a sealing membrane of the gas bottle; and a stressing element, received in the housing; the piercing element being fixed on one end of the stressing element that is close to the gas bottle; the stressing element being synchronously rotatable along with the housing for being inserted into the gas bottle, or individually rotatable and movable with respect to the housing for pushing the piercing element to pierce into the sealing membrane or releasing gas inside the gas bottle;

wherein a first recess is lied across one end of the housing that is away from the gas bottle, and a second recess is lied across one end of the stressing element that is away from the gas bottle; the second recess is capable of aligning with or misaligning with the first recess; when the stressing element is rotated to make the second recess align with the first recess, a semi-open channel with an open mouth facing away from the gas bottle is formed;

an external thread is formed on an outer wall of the stressing element, and an internal thread adapted to the external thread on the stressing element is formed on an inner wall of the housing.

6. The magazine according to claim 5, wherein a sealing ring is provided on an outer wall of the housing and configured for indicating a position of the housing; the piercing device is firmly secured to the gas bottle holder.

7. The magazine according to claim 5, wherein a first stopping portion is formed on an inner wall of an holding casing, and a second stopping portion adapted to the first stopping portion is provided at one end of the housing that is close to the gas bottle.

8. A pistol, comprising a magazine which includes:

a gas bottle, having a sealing membrane sealed at a mouth thereof;

a gas bottle holder, configured for holding the gas bottle; and a piercing device, including:

a housing movable with respect to the gas bottle holder having the gas bottle held therein;

a stressing element, synchronously rotatable along with the housing, or individually rotatable and movable with respect to the housing;

a piercing element received in the housing and fixed on one end of the stressing element that is close to the gas bottle; the piercing element is configured for piercing into a sealing membrane of the gas bottle;

wherein a first recess is lied across one end of the housing that is away from the gas bottle, and a second recess is lied across one end of the stressing element that is away from the gas bottle; the second recess is capable of aligning with or misaligning with the first recess; when the stressing element is rotated to make the second recess align with the first recess, a semi-open channel with an open mouth facing away from the gas bottle is formed;

an external thread is formed on an outer wall of the stressing element, and an internal thread adapted to the external thread on the stressing element is formed on an inner wall of the housing.

* * * * *